US006713727B1

(12) United States Patent
Johnson

(10) Patent No.: US 6,713,727 B1
(45) Date of Patent: Mar. 30, 2004

(54) CAULKING WARMER

(75) Inventor: Ronald W. Johnson, Salt Lake City, UT (US)

(73) Assignee: United Subcontractors, Inc., Salt Lake City, UT (US)

( * ) Notice: Subject to any disclaimer, the term of this patent is extended or adjusted under 35 U.S.C. 154(b) by 0 days.

(21) Appl. No.: 10/274,026

(22) Filed: Oct. 17, 2002

(51) Int. Cl.[7] ..... B67D 5/62; H05B 3/34; H05B 1/02

(52) U.S. Cl. ..... 219/386; 219/201; 222/146.5

(58) Field of Search ..... 219/385, 386, 219/521, 528; 222/146.5

(56) References Cited

U.S. PATENT DOCUMENTS

| | | | | | |
|---|---|---|---|---|---|
| 4,140,893 | A | | 2/1979 | Renteria | 219/385 |
| 4,523,078 | A | * | 6/1985 | Lehmann | 219/386 |
| 4,528,439 | A | | 7/1985 | Marney, Jr. et al. | 219/386 |
| 4,980,539 | A | | 12/1990 | Walton | 219/432 |
| 5,183,994 | A | * | 2/1993 | Bowles, Sr. et al. | 219/387 |
| 5,293,583 | A | * | 3/1994 | Chudgar | 219/385 |
| 5,408,068 | A | * | 4/1995 | Ng | 219/521 |
| 5,408,576 | A | * | 4/1995 | Bishop | 219/386 |
| 5,569,401 | A | * | 10/1996 | Gilliland et al. | 219/386 |
| 5,615,805 | A | * | 4/1997 | Yoncak | 222/146.5 |
| 5,736,714 | A | | 4/1998 | Bechtold, Jr. | 219/521 |
| 5,981,909 | A | * | 11/1999 | Freeman | 219/386 |
| 6,080,974 | A | * | 6/2000 | Ambrosiano | 219/528 |
| 6,144,016 | A | | 11/2000 | Garvin | 219/387 |
| 6,153,674 | A | | 11/2000 | Landin | 524/35 |
| 6,300,599 | B1 | | 10/2001 | Owens et al. | 219/387 |
| 6,384,387 | B1 | | 5/2002 | Owens et al. | 219/601 |

* cited by examiner

*Primary Examiner*—Joseph Pelham
(74) *Attorney, Agent, or Firm*—Stephen M. Nipper; Frank J. Dykas; Robert L. Shaver

(57) ABSTRACT

A portable endothermic caulk warmer for warming at least one tube of endothermic caulk. This caulk warmer having an insulated housing, at least one AC heating pad, a AC/DC power inverter and a DC rechargeable battery.

10 Claims, 3 Drawing Sheets

CAULKING WARMER

BACKGROUND OF THE INVENTION

1. Field of the Invention

The present invention generally relates to heaters, and more particularly relates to heaters utilized to keep unused endothermic caulk from freezing.

2. Background Information

As discussed in U.S. Pat. No. 6,153,674 (Landin), materials used to reduce or eliminate the passage of smoke and flames through openings between walls and floors and openings caused by through penetrations in buildings are collectively known as fire stop, fire retardant or fire barrier materials. Johns Manville refers to one of their fire stop products as an "endothermic caulk."

One disadvantage to the current composition of such endothermic caulk is in preapplication temperature sensitivity. Once installed and cured, endothermic caulk is generally formulated to withstand exposure to weeks of freezing temperatures. However, before the caulk is applied to the surface or opening to be protected, this caulk material is sensitive to damage from freezing, and must be at an acceptable temperature (60° to 80° F.) to accommodate application.

Thus, individuals who apply such caulk must protect the caulk from freezing damage. The typical manner of protecting the caulk from freezing is to ensure that it is never stored in an unheated area. However, merely storing unapplied caulk in a heated area can be extremely inconvenient. Most job sites are unheated. This fact, coupled with the fact that the application of endothermic caulk can be made over a period of days on a large job site, means that caulk protection is a serious issue in cold weather. The only solution is for the users to try to protect the caulk from freezing and keep it at 60°–80° F., while on the job site and then at the end of the work day haul all unused caulk back to the office for storage in a warm location overnight.

This solution is only as reliable as the individuals applying the caulk, and does not keep the caulk at an acceptable application temperature. Forgetting to bring the unused caulk back to the office for warm storage will result in a loss of the caulk due to freezing damage. Such loss can easily add up to thousands of lost dollars of profit a year to a company applying such caulk on job sites.

While the present invention's main intended use is with respect to endothermic caulk, other uses are likewise also possible. For instance, keeping buckets paint from freezing, keeping drywall mud from freezing, etc., while maintaining a suitable application temperature. Thus, the term "endothermic caulk," as used herein, is intended to include any potential material which needs to be kept from freezing and kept warm, particularly including building materials.

What is needed is a method and/or apparatus for portably warming endothermic caulk thereby protecting it from freezing damage and maintaining an acceptable application temperature. The present invention solves this need.

SUMMARY OF THE INVENTION

The present invention is a portable caulk warmer for warming at least one tube of caulk. The inventor refers to the present invention as the "P. J. caulking warmer." This caulk warmer comprising: an insulated housing, a heating pad, a power inverter and a rechargeable battery.

The insulated housing for holding at least one tube of endothermic caulk, this insulated housing having an opening therein, this opening able to be opened and closed. For instance, the housing could be a box having a lid. It is preferred that the insulated housing comprise a plurality of handles for allowing the housing to be lifted. It is preferred that the housing have a plurality of side walls and a bottom wall, these side walls and the bottom wall defining a housing interior.

The heating pad is for supplying a source of heat to the housing interior. At least one heating pad is provided. The preferred heating pad runs on AC power and has high, medium, and low settings. The heating pad being electrically connected to a rechargeable battery. In the case of a DC battery and an AC heating pad, attaching in between will be a AC/DC power inverter. This heating pad will preferably be located inside the housing interior.

The rechargeable battery is for supplying an electrical current to the heating pad. The preferred battery provides DC power. The battery is preferably configured for connection with an AC power source thereby allowing the rechargeable battery to be recharged. Where the battery is DC and the heating pad (or pads) is AC, a DC to AC power inverter is used to convert the power between the battery and the heating pad(s). This battery can be charged through connection with said power source. After the battery is charged, the battery can be disconnected from the power source. Thus, the battery via the inverter powers the heating pad thereby warming the housing interior.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
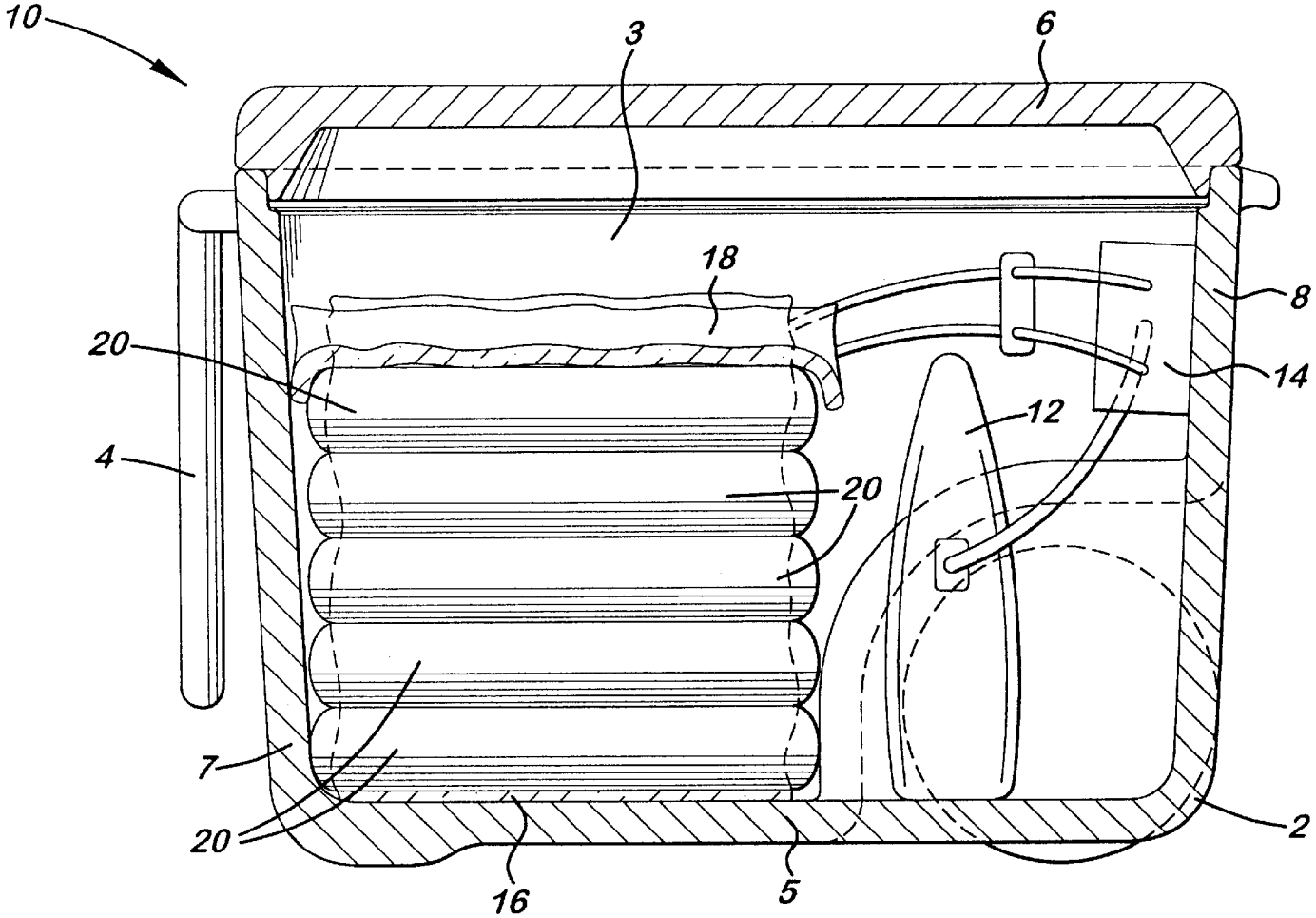
FIG. 1 is a side, cross-sectional view of the preferred embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a method of keeping materials, particularly endothermic caulking, warm at a location where alternating current (A.C.) power is unavailable. For instance, it may be desirable and necessary to keep endothermic caulk warm (at least above freezing) while on a job site during cold weather. The present invention can be utilized to keep other materials warm, for instance paint and drywall mud.

Oftentimes, a job site will not be provided with A.C. power. Likewise, A.C. power is not conveniently located in parking lots and locations where a user's work vehicle may be parked overnight. In such cases, what is needed is a self contained manner of keeping an insulated housing warm so that items and materials stored therein can be protected from damage caused by freezing. Without access to A.C. power, battery power becomes a manner of supplying electricity to such a portable housing.

Figure 2:
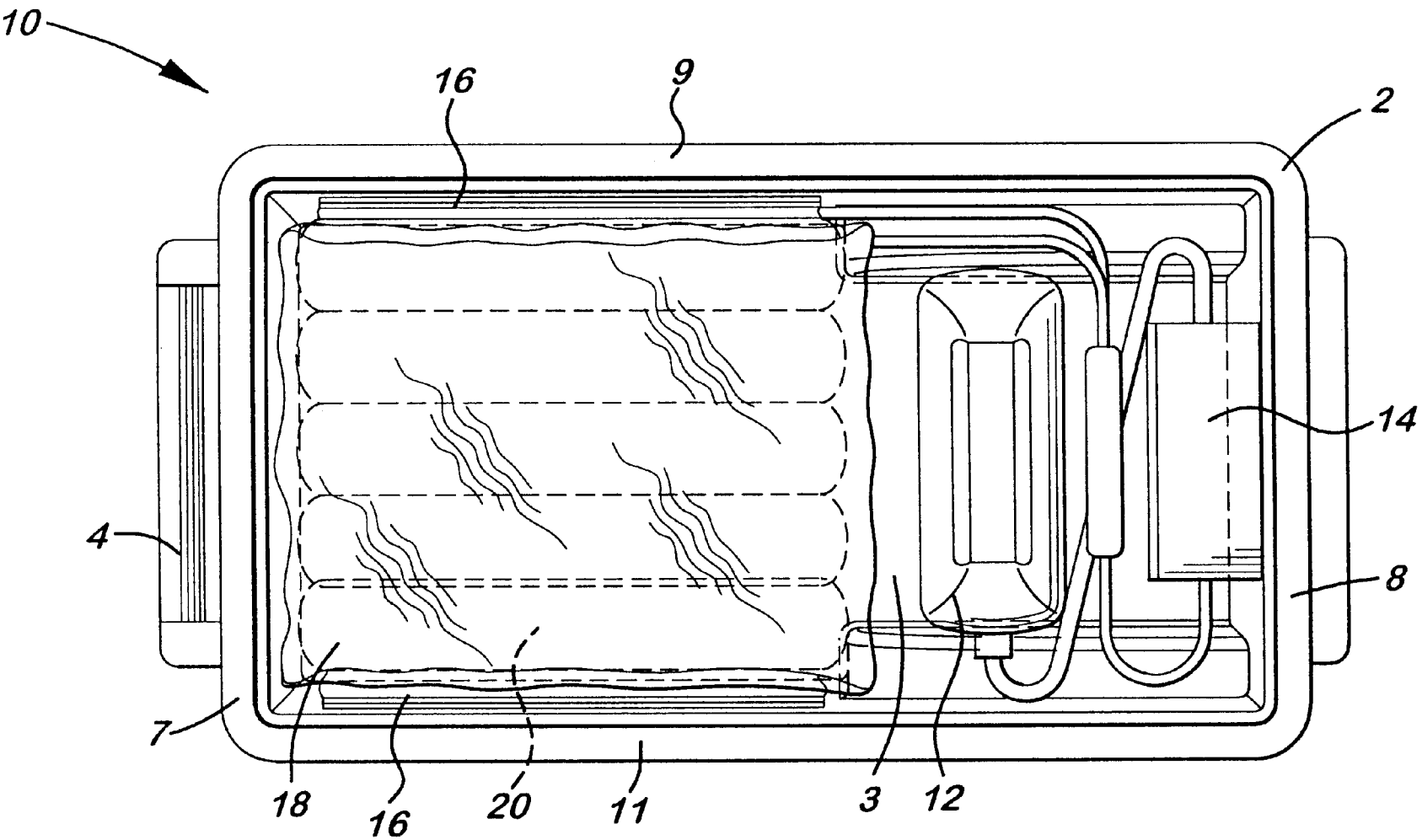
FIG. 2 is a top, partial view of the embodiment of FIG. 1.
Figure 3:
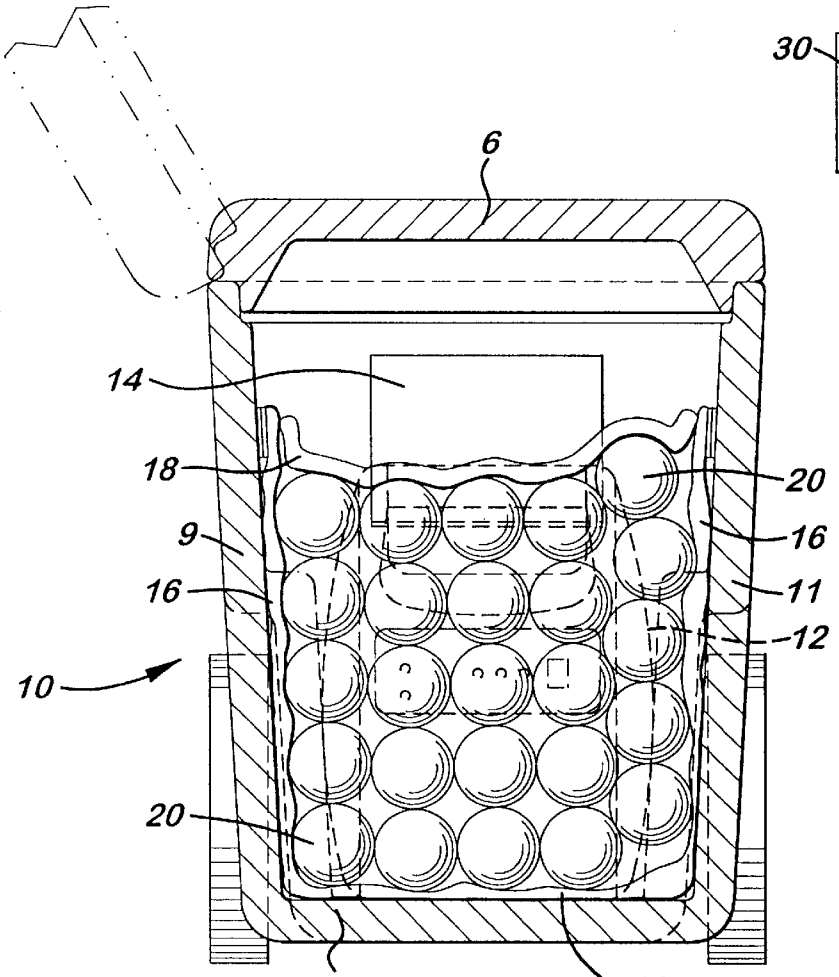
FIG. 3 is a first end cross-sectional, partial view of the embodiment of FIG. 1.

Referring initially to FIGS. 1–3, show is the preferred embodiment of the present invention 10. The present invention comprises a container 2 having a storage compartment 3. This container 2 preferably having a lid 6. It is preferred that the container and lid be insulated. This storage compartment 3 defined within the container 2 via a pair of first opposing side walls 7, 8 a pair of second opposing side walls 9, 11 and a bottom wall 5. It is preferred that the container have a plurality of side walls, but a single side wall (i.e., tubular) could also work.

It is preferred that the container has one or more handles 4 for allowing the container to be manipulated easily by a user. The preferred container is a 56-quart beverage cooler having a drag handle and a pair of wheels. Typically, such beverage cooler lids are not insulated. It is preferred that insulation be added to or in said lid.

Figure 4:
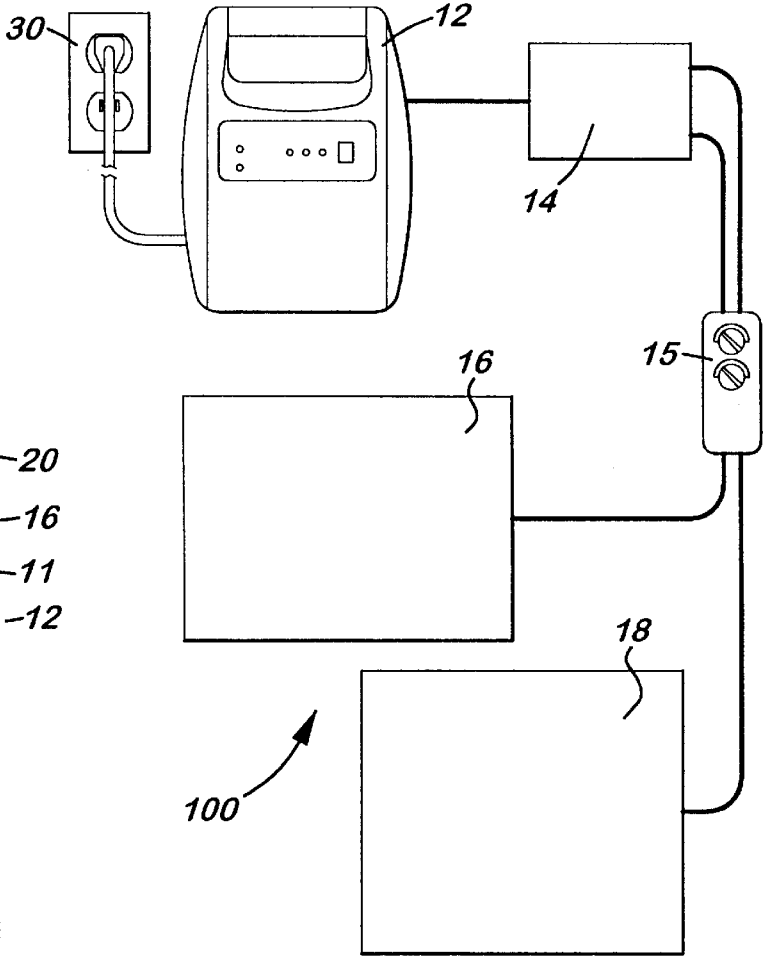
FIG. 4 is a representational view of a second embodiment of the present invention.

A battery preferably powers the present invention. The preferred battery 12 utilized is an twelve-Amp hour, rechargeable, gel lead acid battery. Other types and manners of batteries are likewise possible, including but not limited to an eighteen-Amp hour battery. It is preferred that the battery 12 be configured to be electrically connected to a 110-volt A.C. power source 30 (as shown in FIG. 4) for recharging. Other manners of recharging are also possible, including, but not limited to, twelve volt automotive (including twelve volt "cigarette lighter"), solar, wind, etc. In the preferred embodiment, the battery has a twelve-volt direct current (D.C.) output.

The preferred embodiment 10 utilizes one or more A.C. heating pads 16, 18. As such, a manner of converting the direct current (D.C.) supplied by the battery 12 to alternating current (A.C.) needed by the heating pad(s) is needed. In the preferred embodiment this is accomplished through use of an D.C. to A.C. inverter 14 incorporated between the battery 12 or batteries and the heating pad 16 or pads (16, 18). The preferred inverter 14 incorporates a low battery alarm that automatically shuts off the inverter 14 to protect the battery 12 if and when the battery's charge becomes low. This inverter inverts the twelve-volt D.C. output of the battery to 110-volt A.C. The preferred inverter 14 is a 140-watt inverter.

The preferred embodiment of the present invention 10 utilizes both a bottom heating pad 16 and a top heating pad 18. The number of heating pads may vary dependent upon the wishes of the user, the amount and type of material stored in the housing, an the environmental conditions present. For instance, any combination of top, bottom, side and end pads may be utilized. It is preferred that at least one bottom heating pad 16 be utilized, but the present invention may alternatively include only a top heating pad 18. While a heating "pad" is utilized with the present invention, it is expressly intended that such "pad" include all manners of converting an electrical current to heat, including but not limited to what is commonly referred to as a heating "pad."

The preferred bottom heating pad 16 is preferably attached inside the storage compartment 3 in such a manner as to extend up both side walls 9, 11. In the preferred embodiment, the bottom heating pad 16 is a 12"×24" 50-watt, 110-volt A.C. heating pad. By being powered by 110-volt A.C., the heating pad 16 could be unplugged from the present invention and directly plugged into standard 110-volt A.C., if for instance A.C. power happened to be available at the job site and the conservation of battery power was desired.

The preferred top heating pad 18 is a 12"×15" 50-watt, 110-volt A.C. heating pad. By being 110-volt A.C., the heating pad 18 could likewise be unplugged from the present invention and directly plugged into standard 110-volt A.C., for instance if A.C. power was available at the job site and the conservation of battery power was desired.

It is preferred that the heating pad(s) be able to be mounted on Velcro® style hook-and-loop fasteners within the housing (storage compartment) so that they can be easily replaced, removed or rearranged, if necessary. Other means of attachment are also possible, including brackets, tape, bags, buckles, straps, adhesives, etc. Likewise, the components could also be formed into the housing itself.

It is preferred that in use the present invention will maintain the temperature on D.C. power for a full workday (eight to twelve hours). If desired, the present invention can be used as a heater by using both heating pads 16, 18 drawing current from 110-volt A.C. In the preferred embodiment, by running as a heater, the present invention is able to heat twenty-four 20-ounce tubes of endothermic caulking 20 approximately 40 to 50 degrees Fahrenheit in approximately a twelve-hour period.

The housing or cooler 2 utilized is preferably insulated, having a closing lid 6. Such a housing 3 preferably having a plurality of rigid side walls 7, 8, 9, 11 and a rigid bottom wall 5. These side walls and bottom wall defining a housing interior or storage compartment 3. Such an insulated housing having an opening therein, this opening able to be opened and closed, preferably via the aforementioned lid. It is preferred that the insulated housing have at least one handle 4 for allowing the housing to be lifted and moved from a first location to a second location. An example of a suitable housing is a fifty-six (56) quart cooler, such as those made by Coleman®.

A thermometer may also be provided with the present invention to allow a user to determine and monitor the temperature of the material located within the warmer. A power switch(es) for turning the present invention on and off is also preferably provided. Such a thermometer and/or power switch(es) would preferably be located within a control unit 15, as shown in FIG. 4. Alternatively, these components could be separate rather than integral within a singular control unit. FIG. 4 shows a second embodiment of the present invention 100.

The present invention is preferably portable. Being portable allows the user to move the insulated housing of the present invention to and around a job site. This portability may be assisted through use of handles, wheels, etc., as necessary.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A portable caulk warmer for warming at least one tube of caulk, said caulk warmer comprising:

a housing for holding said caulk, said housing having an opening therein, said opening able to be opened and closed, said housing having at least one side wall and a bottom wall, said side wall and said bottom wall defining a housing interior;

at least one heating pad for supplying a source of heat to said housing interior, said heating pad electrically connected to a battery, said heating pad located inside said housing interior, said heating pad is configured to be powered by alternating current power;

a power source for supplying an electrical current to said heating pad, wherein said power source is a rechargeable battery configured to supply direct current power; and a power inverter for inverting said battery's direct current power to alternating current thereby providing the alternating current required by said heating pad.

2. The caulk warmer of claim 1, wherein said housing is insulated.

3. The caulk warmer of claim 1, wherein the number of heating pads is two.

4. A portable caulk warmer for warming at least one tube of caulk, said caulk warmer comprising:

an insulated housing for holding said caulk, said insulated housing having an opening therein, said opening able to be opened and closed, said housing having a plurality of side walls and a bottom wall, said side walls and said bottom wall defining a housing interior;

at least one alternating current heating pad for supplying a source of heat to said housing interior, said heating pad electrically connected to a rechargeable battery via a power inverter, said heating pad located inside said housing interior;

a direct current rechargeable battery for supplying an electrical current to said heating pad, said battery configured for connection with an alternating current power source thereby allowing said rechargeable battery to be recharged; and a direct current to alternating current power inverter connecting between said battery and said heating pad for allowing said battery to power said heating pad;

wherein said battery can be charged through connection with said power source, whereby after said battery is charged said battery can be disconnected from said power source; wherein said battery via said inverter powers said heating pad thereby warming said housing interior.

5. The caulk warmer of claim 4, wherein said insulated housing comprising a plurality of handles for allowing said housing to be lifted.

6. The caulk warmer of claim 4, wherein the number of AC heating pads is two.

7. The caulk warmer of claim 4, wherein said opening is closed through use of a lid.

8. The caulk warmer of claim 6, wherein said lid is insulated.

9. A portable caulk warmer for warming a plurality of tubes of caulk, said caulk warmer comprising:

an insulated housing for holding said caulk, said insulated housing having an opening therein, said opening closed by an insulated lid, said housing having a plurality of side walls and a bottom wall, said side walls and said bottom wall defining a housing interior;

a first alternating current heating pad for supplying a source of heat to said housing interior, said first alternating current heating pad electrically connected to a rechargeable battery via a power inverter, said first alternating current heating pad located inside said housing interior;

a second alternating current heating pad for supplying a source of heat to said housing interior, said second alternating current heating pad electrically connected to a rechargeable battery via a power inverter, said second alternating current heating pad located inside said housing interior;

a direct current rechargeable battery for supplying an electrical current to said first and second heating pads, said battery configured for connection with an alternating current power source thereby allowing said rechargeable battery to be recharged; and a direct current to alternating current power inverter connecting between said battery and said first and second heating pads for allowing said battery to power said first and second heating pads;

wherein said battery can be charged through connection with said power source, whereby after said battery is charged said battery can be disconnected from said power source; wherein said battery via said inverter powers said first and second heating pads thereby warming said housing interior.

10. The caulk warmer of claim 9, wherein said insulated housing comprising a plurality of handles for allowing said housing to be lifted.

* * * * *